US006663263B2

(12) United States Patent
Yu

(10) Patent No.: US 6,663,263 B2
(45) Date of Patent: Dec. 16, 2003

(54) ONE-PIECE COLLAPSIBLE LAMPSHADE

(76) Inventor: Alexander Yu, 10F-1, No. 1, Lane 106, Sec. 3, Min-Chuan E. Rd., Taipei City (TW)

( * ) Notice: Subject to any disclaimer, the term of this patent is extended or adjusted under 35 U.S.C. 154(b) by 0 days.

(21) Appl. No.: 10/107,957

(22) Filed: Mar. 27, 2002

(65) Prior Publication Data

US 2003/0185013 A1 Oct. 2, 2003

(51) Int. Cl.[7] ..... F21V 17/00

(52) U.S. Cl. ..... 362/352; 362/351; 362/430; 362/433; 362/450; 362/456

(58) Field of Search ..... 362/352, 351, 362/430, 433, 450, 356

(56) References Cited

U.S. PATENT DOCUMENTS 5,375,048 A 12/1994 Barnes
5,711,599 A * 1/1998 Teng ..... 362/352
6,315,434 B1 11/2001 Long
6,443,600 B1 * 9/2002 Wu ..... 362/352

* cited by examiner

*Primary Examiner*—Sandra O'Shea
*Assistant Examiner*—Bertrand Zeade
(74) *Attorney, Agent, or Firm*—John H. Crozier

(57) ABSTRACT

A collapsible lampshade includes an upper ring, a lower ring, a plurality of upper ribs each having a first end pivoted to the upper ring and a second end part, and a plurality of lower ribs each having a third end which is pivoted to the lower ring and a fourth end part which has a connection part pivoted to the second end part. The connection part has a pair of flaps extending over and pivoted to the second end part. Releasable interengagement elements are formed on the flaps and the second end part for locking the second end part from movement relative to the flaps. The lampshade has a simple construction and can be stretched and locked in the stretched state in a convenient manner using few component parts.

5 Claims, 3 Drawing Sheets

ONE-PIECE COLLAPSIBLE LAMPSHADE

BACKGROUND OF THE INVENTION

1. Field of the Invention

The invention relates to a lampshade, particularly to a collapsible lampshade which has a flexible cover supported by a foldable frame.

2. Description of the Related Art

Lampshades are normally bulky and occupy large spaces during transport and storage. In order to reduce the spaces required by lampshades during transportation or storage, the prior art has suggested various forms of collapsible lampshades which can be kept in a compact size when collapsed. In one type of collapsible lampshade, separate multiple frame parts are provided for assembly into a lampshade frame, and a flexible lampshade cover is fitted over the lampshade frame. Since the frame parts and the lampshade cover are separated before assembly, they can be packed into a compact size to facilitate transport and storage. Another type of collapsible lampshade is produced by providing multiple complementary parts each having a frame part integral with a lampshade cover. The complementary parts can be stacked to reduce the lampshade size and can be interconnected to form a lampshade. Nevertheless, in either type of collapsible lampshade, there is a risk of loosing parts, or damage during shipment due to the movement of loose parts against one another.

In order to alleviate the aforesaid problems, U.S. Pat. No. 6,315,434 suggests a one-piece collapsible lampshade in which a frusto-conical flexible lampshade cover is integrated with a collapsible frame. The frame includes an upper ring attached to an upper end of the lampshade cover, a lower ring attached to a lower end of the lampshade cover, and a plurality support rods each having one end permanently and pivotally attached to the lower ring and another end removably inserted into a receptacle fixed to the upper ring. When the support rods are removed from the upper ring, both of the frame and cover are collapsed to a substantially flat configuration so that the lampshade can be kept in a compact size as a whole without separation. However, inconveniences are encountered when the support rods are to be attached to the upper ring to place the frame in an uncollapsed state because a considerable amount of energy is required to push or pull the upper ring away from the lower ring against the tension of the flexible cover so as to insert the support rods into the respective receptacles mounted on the upper ring. In addition, the force applied to the upper ring must keep the upper ring balanced in order to ensure extension of the support rods into the respective receptacles.

U.S. Pat. No. 5,375,048 discloses a collapsible frame which is comprised of upper and lower rings, and a plurality of rib members each having two ends respectively pivoted to the upper and lower rings. Each rib member has a hinge at its middle part and is thus foldable to permit the frame to lie flat with the upper and lower rings stacked. The frame additionally includes a slider disposed around each rib and slidable along the rib to move over and away from the hinge.

When each slider moves over the corresponding hinge, each rib is locked from its folding movement so that the frame can be stretched to an uncollapsed state. The frame further includes a spider disposed between the upper and lower rings to operate the sliders. This collapsible frame requires extra components to lock the frame in a stretched state and thus has a complicated construction.

SUMMARY OF THE INVENTION

An object of the present invention is to provide a collapsible lampshade with a simple construction in which foldable ribs can be unfolded and locked in a stretched operative state without the need to provide extra components.

Accordingly, a lampshade of the present invention comprises: an upper ring; a lower ring; a plurality of upper ribs each having a first end pivoted to the upper ring, and a second end part; a plurality of lower ribs each having a third end pivoted to the lower ring and a fourth end part, the fourth end part having a connection part pivoted to the second end part, the connection part having a pair of flaps extending over two opposite sides of the second end part and pivoted to the second end part; and releasable interengagement elements formed on the flaps and the second end part to engage the second end part with the flaps and to lock the second end part from movement relative to the flaps.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
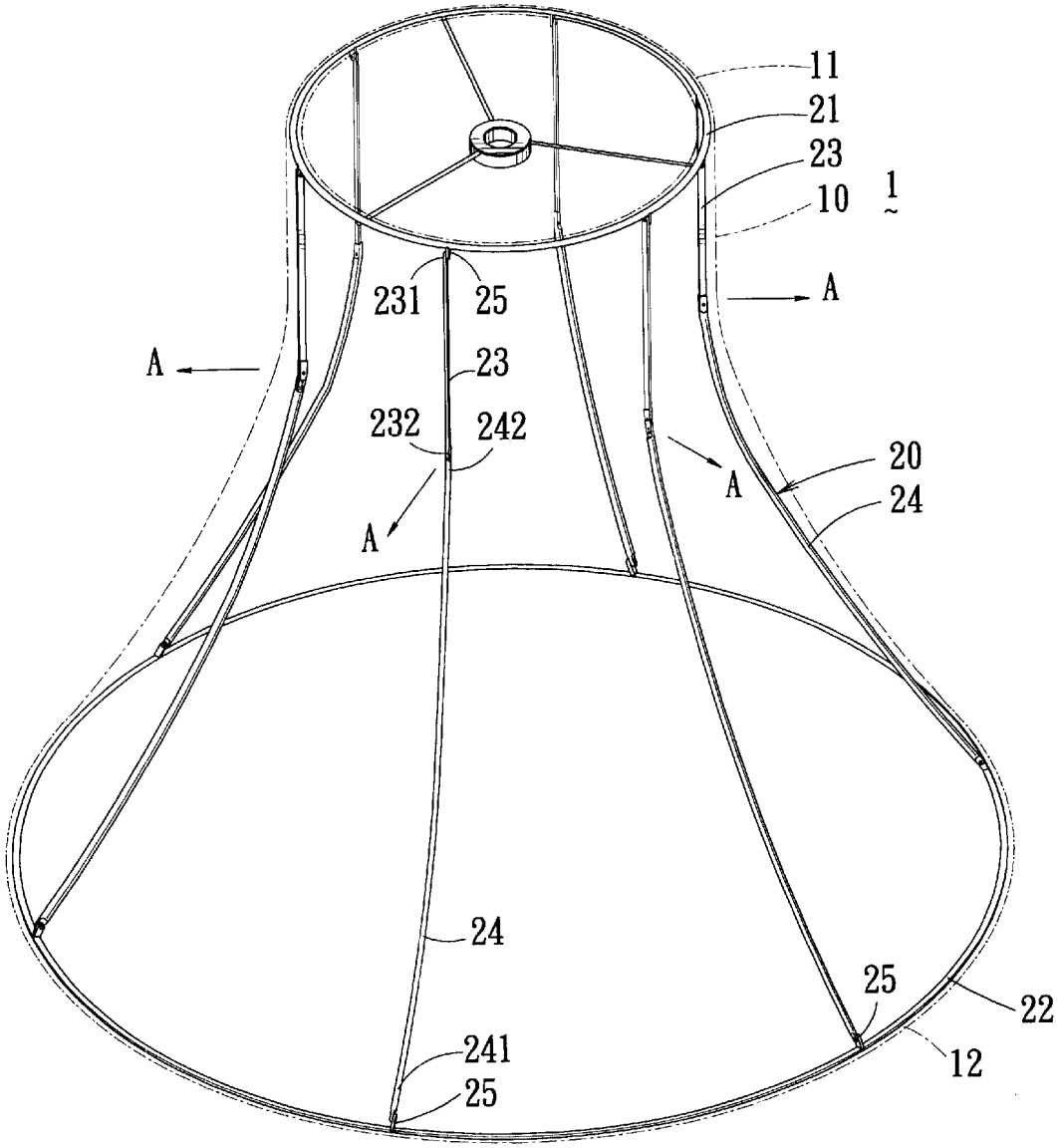
FIG. 1 is a perspective view of a collapsible lampshade embodying the present invention.

Referring to FIG. 1, a lampshade 1 embodying the present invention is shown to include a frusto-conical flexible cover 10 made of a fabric material, and a collapsible frame 20 made of a metal. The frame 20 includes an upper ring 21, a lower ring 22 greater than the upper ring 21, a plurality of upper and lower ribs 23, 24. The flexible cover 10 has upper and lower ends 11, 12 which are folded and fixed, respectively, to the upper and lower rings 11, 12 in a conventional manner.

Figure 2:
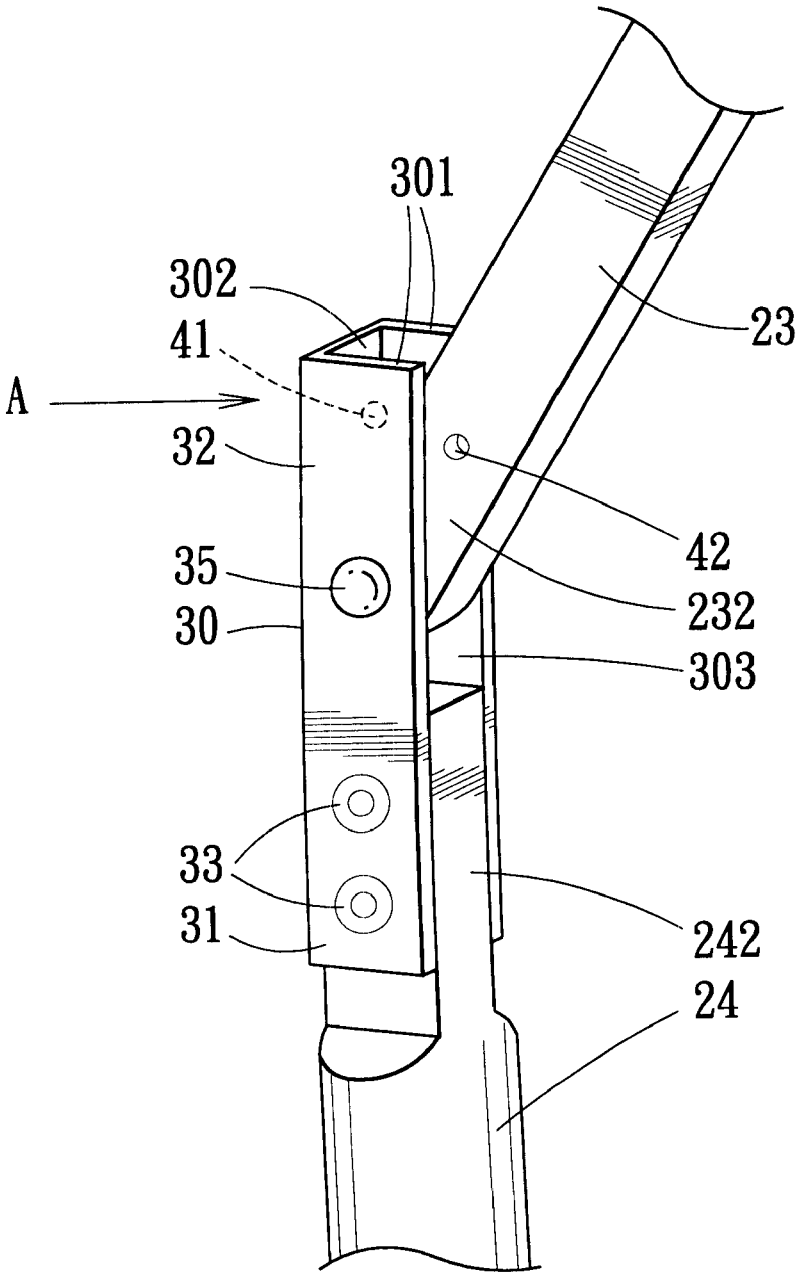
FIG. 2 is a fragmentary perspective view showing a connection between upper and lower ribs of the collapsible lampshade of FIG. 1.

Each of the upper and lower rings 21, 22 has a plurality of spaced apart pivot seats 25 projecting therefrom. Each upper rib 23 has one end 231 pivoted to the corresponding pivot seat 25 of the upper ring 21, and each lower rib 24 has one end 241 pivoted to the corresponding pivot seat 25 of the lower ring 22. Another end part 232 of each upper rib 23 is connected pivotally to another end part 242 of the corresponding lower rib 24 by means of a connection part 30, as shown in FIG. 2. The connection part 30 has a generally U-shaped cross-section and may be formed as one piece with or as a separate piece from the end part 242 of the corresponding lower rib 24. In this embodiment, the connection part 30 in the form of a separate piece is used and includes a pair of substantially parallel flaps 301 interconnected by a bight portion 302.

Figure 3:
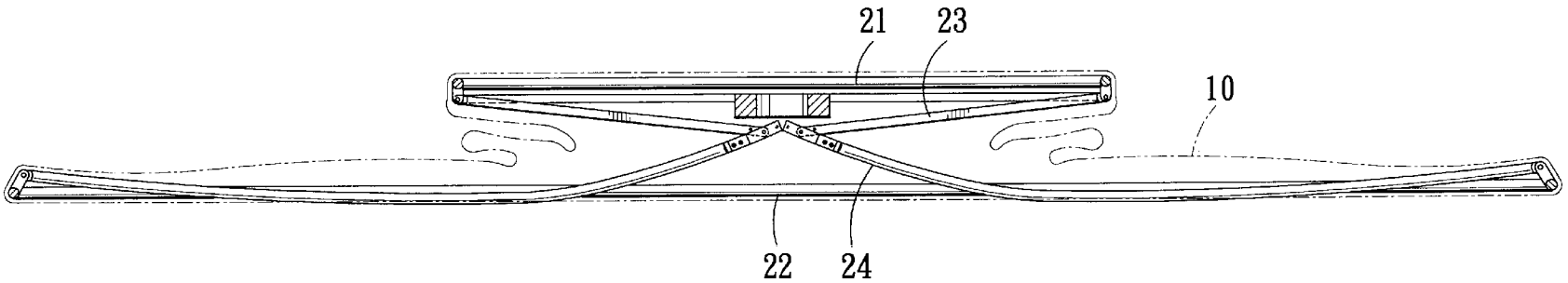
FIG. 3 is an elevation view showing the collapsible lampshade in a folded state.

The connection part 30 has one end portion 31 receiving the end part 242 of the corresponding lower rib 24 and another end portion 32 opposite to the end portion 31. The end portion 31 is connected rigidly to the end part 242 of the lower rib 24 via rivets 33. The end part 232 of the corresponding upper rib 23 extends between the flaps 301 and is pivoted to the connection part 30 between the end portions 31 and 32 via a pin 35. As a result, the upper rib 23 is turnable relative to the lower rib 24 so as to fold over the lower rib 24. Since the upper ribs 23 are foldable over the lower ribs 24, the upper ring 21 is permitted to move toward the lower ring 22 and the frame 20 can be collapsed to a state as shown in FIG. 3.

The frame 20 is further provided with interengagment elements, which are formed as a pair of protrusions 41 and a pair of recesses 42, as shown in FIG. 2. The pair of protrusions 41 respectively project inward from inner surfaces of the flaps 301, and the pair of recesses 42 are respectively formed in two opposite sides of the end part 232 of the upper rib 23. Note that each connection part 30 has an open side 303 that faces in a direction towards the outside of the frame 20, and the bight portion 302 extends inwardly of the open side 303.

When the lampshade 1 is to be used, the frame 20 is stretched to an operative state by moving the upper ring 21 away from the lower ring 22 and by pushing the end part 232 of each upper rib 23, or the end part 242 of each lower rib 24, or each connection part 30 along a radially outward direction as shown by arrows (A) in FIG. 1. In this situation, the bight portion 302 of each connection part 30 abuts against an inner side of the corresponding upper rib 23, and the protrusions 41 on each connection part 30 respectively engage the recesses 42 of the corresponding upper rib 23. As a result, the upper ribs 23 are locked from folding over the respective lower ribs 24 and the frame 20 is placed in a stretched operative state, as shown in FIG. 1.

As described above, the frame 20 can be stretched or locked in its stretched state by simply pushing outward the upper ribs 23 and/or the lower ribs 24 near or at the connection parts 30. When the upper ribs 23 and/or the lower ribs 24 are pushed inward, the frame 20 can be folded. It can be appreciated that the collapsible lampshade 1 is constructed with fewer component parts and can be folded or unfolded in a simple manner with less effort as compared to the conventional collapsible lampshades described hereinbefore.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A lampshade, comprising:

an upper ring;

a lower ring;

a plurality of upper ribs each having a first end pivoted to said upper ring, and a second end part opposite to said first end part;

a plurality of lower ribs each having a third end pivoted to said lower ring and a fourth end part opposite to said third end, said fourth end part having a connection part pivoted to said second end part, said connection part having a substantially U-shaped cross-section and including a pair of flaps and a bight portion interconnecting said flaps, said flaps and said bight portion projecting from said fourth end part along lines parallel to the direction of extension of said lower rib and surrounding said second end part, and a pivot pin extending through said flaps and said second end part; and releasable interengagement elements formed on said flaps and said second end part to engage said second end part with said flaps and to lock said second end part from movement relative to said flaps, said interengagement elements including at least one protrusion and at least one recess for engaging said protrusion when said upper and lower ribs are in an unfolded position, wherein said connection part further includes an open side formed between said flaps opposite to said bight portion, said open sides of said connection parts of all of said lower ribs facing in outward directions towards the outside of the lampshade, said bight portion extending inwardly of said open side and abutting against a corresponding one of said upper ribs when said upper and lower ribs are in the unfolded position.

2. The lampshade as claimed in claim 1, wherein said upper ring has a plurality of pivot seats projecting therefrom to connect respectively with said upper ribs, said lower ring having a plurality of pivot seats projecting therefrom to connect respectively with said lower ribs.

3. The lampshade as claimed in claim 1, further comprising a flexible cover which has an upper end attached to said upper ring and a lower end attached to said lower ring, said flexible cover extending around said upper and lower ribs.

4. The lampshade as claimed in claim 1, wherein said interengagement elements include a pair of said protrusions formed respectively on said flaps and a pair of said recesses formed respectively in said two opposite sides of said second end part to engage said protrusions.

5. The lampshade as claimed in claim 3, wherein said flexible cover has a frusto-conical shape, said lower ring being greater than said upper ring.

* * * * *